US007478621B2

(12) United States Patent
Muetzel et al.

(10) Patent No.: US 7,478,621 B2
(45) Date of Patent: Jan. 20, 2009

(54) METHOD OF COMPENSATING FOR ENGINE SPEED OVERSHOOT

(75) Inventors: Ronald P. Muetzel, Friedrichshafen (DE); Robert A. Sayman, Laurinburg, NC (US); James H. DeVore, Laurinburg, NC (US)

(73) Assignee: ZF Friedrichshafen AG, Friedrichshafen (DE)

( * ) Notice: Subject to any disclaimer, the term of this patent is extended or adjusted under 35 U.S.C. 154(b) by 279 days.

(21) Appl. No.: 11/401,777

(22) Filed: Apr. 11, 2006

(65) Prior Publication Data

US 2007/0238576 A1 Oct. 11, 2007

(51) Int. Cl.
*F02D 45/00* (2006.01)

(52) U.S. Cl. ..... 123/352

(58) Field of Classification Search ..... 123/350, 123/352, 355, 356, 339.19
See application file for complete search history.

(56) References Cited

U.S. PATENT DOCUMENTS 4,217,867 A 8/1980 Madsen et al.
4,636,957 A 1/1987 Otobe et al.
4,727,472 A 2/1988 Deutsch et al.
4,912,642 A 3/1990 Larsen et al.
5,299,539 A 4/1994 Kurihara
5,726,892 A * 3/1998 Tang et al. ..... 123/352
5,934,247 A 8/1999 Hashimoto et al.
6,003,489 A 12/1999 Kamura et al.
6,055,971 A * 5/2000 Beechie et al. ..... 123/339.19
2003/0047164 A1 * 3/2003 Jaye ..... 123/352
2004/0084907 A1 5/2004 Kuribayashi et al.

* cited by examiner

*Primary Examiner*—Erick Solis
(74) *Attorney, Agent, or Firm*—Brinks Hofer Gilson & Lione

(57) ABSTRACT

A method for controlling the speed of internal combustion engines in heavy duty trucks and the like compensates for the overshoot, i.e., the difference between a targeted or commanded engine speed and a transient overspeed or underspeed. The method comprehends executing a program or subroutine where a throttle or engine speed change command is received by a controller, the engine speed change is monitored, a value of overshoot (on both an engine speed increase or decrease) is detected and the detected overshoot is subsequently utilized to temporarily reduce the speed change command, thereby effectively eliminating the overshoot and more positively and quickly arriving at the targeted engine speed.

20 Claims, 4 Drawing Sheets

70
START
72
SET
UOS = 0
DOS = 0
74
SENSE ENGINE ACTIVITY
(FESU,FESD,ΔES )
76
IS
ΔES > 0
?
78
NO
YES
IS
ΔES > PV
?
82
NO
IS
|ΔES| > PV
?
84
NO
YES
SENSE MAX. ES
86
SENSE MIN. ES
92
SET UOS = MAX. ES - FESU
88
SET DOS = FESD - MIN. ES
94
EXIT
90
START
B

METHOD OF COMPENSATING FOR ENGINE SPEED OVERSHOOT

TECHNICAL FIELD

The invention relates generally to control methods for internal combustion engines and more specifically to a control method which determines engine speed overshoot and compensates for such overshoot by subsequently, temporarily adjusting a speed change command by the determined overshoot value.

BACKGROUND

Particularly in two state or on/off control systems but also in proportional and more sophisticated control systems, overshoot is a common but unwanted operational reality. Overshoot may generally be defined as an undesirable and excess response to a control signal resulting in the controlled variable temporarily exceeding or overshooting the new, desired or target controlled value. The analysis of control overshoot and undershoot will not be addressed here beyond the acknowledgement that while overshoot or undershoot are generally undesirable and are to be minimized, such minimization carries with it compromises such as reduced speed of response and steady state errors, to name but two.

Control errors such as overshoot reside in many control systems, especially those associated with massive, mechanical devices. The manufacturer of motor vehicles and particularly heavy duty automated truck transmissions are often faced with control and overshoot challenges. Clearly, rapid, smooth and positive gear shifts are a most desired goal. However, each engine (and its electronic controller) with which a truck transmission may be mated will have slightly different speed, power and torque versus time characteristics. For example, in response to a throttle position change, one engine may accelerate and decelerate differently from another engine and may exhibit these differences in a distinct manner across various regions of the speed, power and torque curves.

For example, a command to one type or brand of engine to increase its speed from 1500 to 2000 rpm may achieve a first grouping of values of acceleration, elapsed time, overshoot and time to final, steady state speed, while another equally suitable type or brand of engine will exhibit another quite distinct grouping of values.

One of the significant areas of performance difference which implicates both the engine and its electronic control is overshoot, i.e., the tendency, upon receipt of a speed change command, to briefly exceed or overshoot either in a positive or negative direction, the new or target speed value. Such overshoot, if unaddressed, may result in an apparently poorly executed shift. For example, if a transmission/clutch controller determines during a downshift that the master clutch will be engaged when the engine speed 2000 rpm, the transmission/clutch controller will track the increasing engine speed and determine that at a specific future time, the engine speed will be 2000 rpm. Since at that specific future time, the engine speed will match the transmission input shaft speed in the newly selected gear, the master clutch should be engaged. Unfortunately, due to overshoot, the engine speed may briefly rise to 2050 rpm or 2075 rpm and then decay to 2000. If clutch engagement occurs above the 2000 rpm target speed and especially if it engages at or near peak rpm of 2075 rpm, a perceptible lurch will be experienced by the vehicle operator. Beyond momentary operator and passenger discomfort, such a lurch is indicative of a driveline torque surge and results in stress on the driveline components, especially the master clutch, which is highly undesirable. The present invention addresses the problem of engine/controller overshoot and detects the actual overshoot of an engine/controller combination and compensates for such overshoot.

SUMMARY

A method for controlling the speed of internal combustion engines in heavy duty trucks and the like compensates for the overshoot, i.e., the difference between a targeted or commanded engine speed and a transient overspeed or underspeed. The method comprehends executing a program or subroutine where a throttle or engine speed change command is received by a controller, the engine speed change is monitored, a value of overshoot (on both an engine speed increase or decrease) is detected and the detected overshoot is subsequently utilized to temporarily reduce the speed change command, thereby effectively eliminating the overshoot and more positively and quickly arriving at the targeted engine speed.

Thus it is an object of the present invention to provide a method for compensating for internal combustion engine overshoot in engine/controller systems.

It is a further object of the present invention to provide a method for detecting engine overshoot and utilizing such detected overshoot to compensate for such engine overshoot in subsequent operating cycles.

It is a still further object of the present invention to provide a method for detecting engine overshoot of a particular internal combustion engine and compensating for such overshoot in a particular engine/controller system.

Further objects and advantages of the present invention will become apparent by reference to the following description of the preferred embodiment and appended drawings wherein like reference numbers refer to the same component, element or feature.

DESCRIPTION

Figure 1:
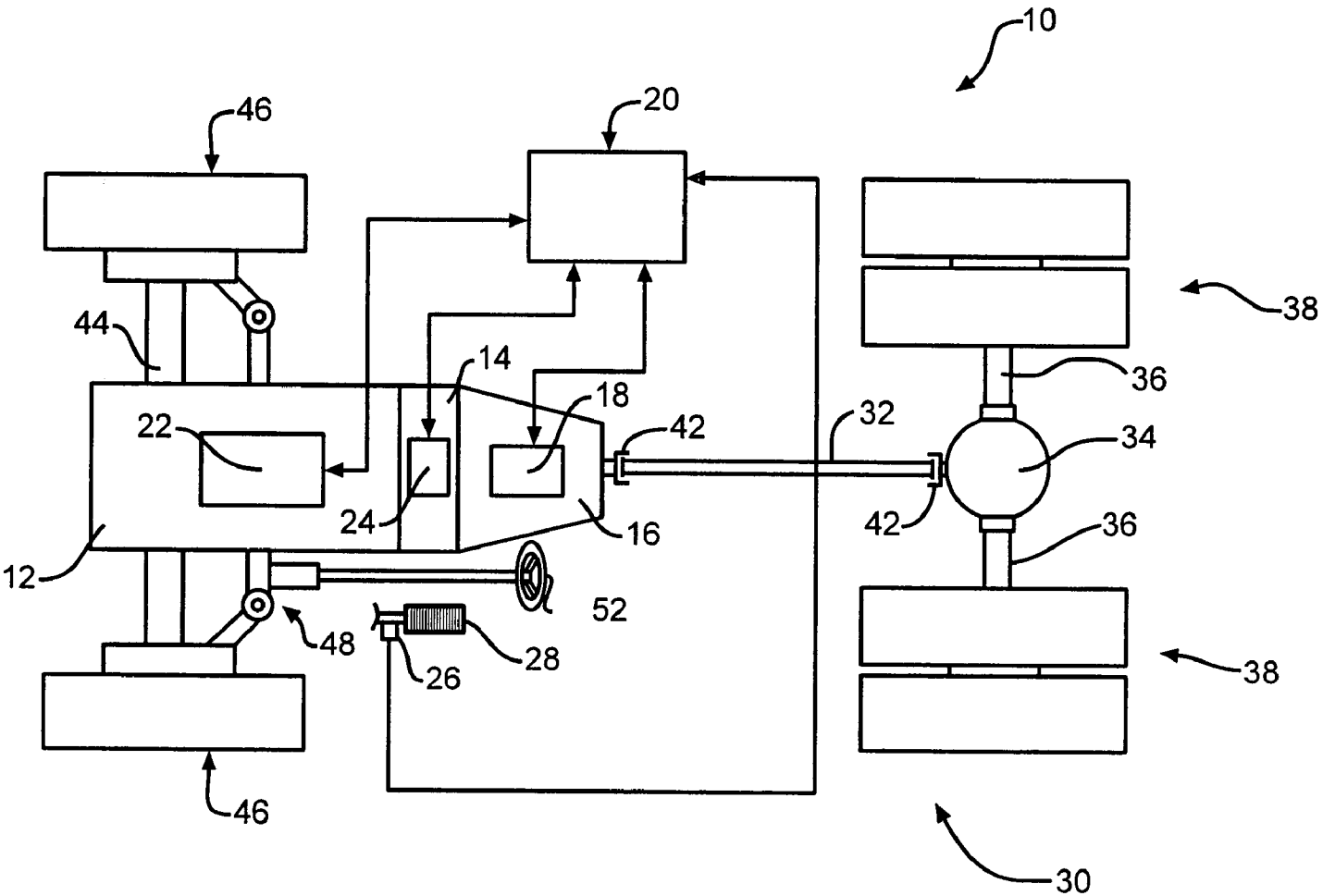
FIG. 1 is a diagrammatic, plan view of truck tractor incorporating the present invention.

Referring now to FIG. 1, a diagrammatic, plan view of a typical truck tractor incorporating the present invention is illustrated and generally designated by the reference number 10. The truck tractor 10 includes a prime mover 12 which may be an internal combustion gas or Diesel engine having an output provided directly to a master friction clutch 14. The master friction clutch 14 selectively and positively engages the output of the prime mover 12 to an input of a multiple speed gear change transmission 16. The transmission 16 is preferably of the type currently designated an automated mechanical transmission (AMT) wherein gear or speed ratio changes of a main transmission, a splitter and a planetary gear assembly, for example, are all achieved by an automated, i.e., electric, hydraulic or pneumatic, shift and actuator assembly 18 under the control of a master microprocessor or controller 20. The master microprocessor or controller 20 also includes a data and control link to an engine controller 22 which will typically include an engine speed sensor and a fuel control or metering device capable of adjusting and controlling the speed of the prime mover 12. The master controller 20 also preferably provides control signals to a master friction clutch operator assembly 24 which controls the engagement and disengagement of the master friction clutch 14. A throttle position sensor 26 senses the position of a vehicle throttle or accelerator pedal 28 and provides real time data regarding the position of the throttle pedal 28 to the master controller 20.

The output of the transmission 16 is provided to a rear driveline assembly 30 which includes a rear propshaft 32 which drives a conventional rear differential 34. The rear differential 34 provides drive torque to a pair of axles 36 which are in turn coupled to left and right tire and wheel assemblies 38 which may be either a dual configuration illustrated or a single left and right tire and wheel assembly. Suitable universal joints 42 may be utilized as necessary with the rear propshaft 32 to accommodate static and dynamic offsets and misalignments thereof. A stationary front axle 44 pivotally supports a pair of front tire and wheel assemblies 46 which are controllably pivoted by a steering linkage 48 which is coupled to and positioned by a steering wheel 52.

As described, the present invention relates to learning the overshoot characteristics of an internal combustion engine in both the accelerating and decelerating modes, storing such positive and negative overshoot values and subsequently utilizing such overshoot values to compensate for such overshoot by temporarily reducing the target speed in an engine accelerating mode and temporarily increasing the target speed in an engine decelerating mode and, once the engine has achieved the adjusted target speed, allowing the engine or prime mover to seek and quickly achieve the actual target speed.

Figure 2:
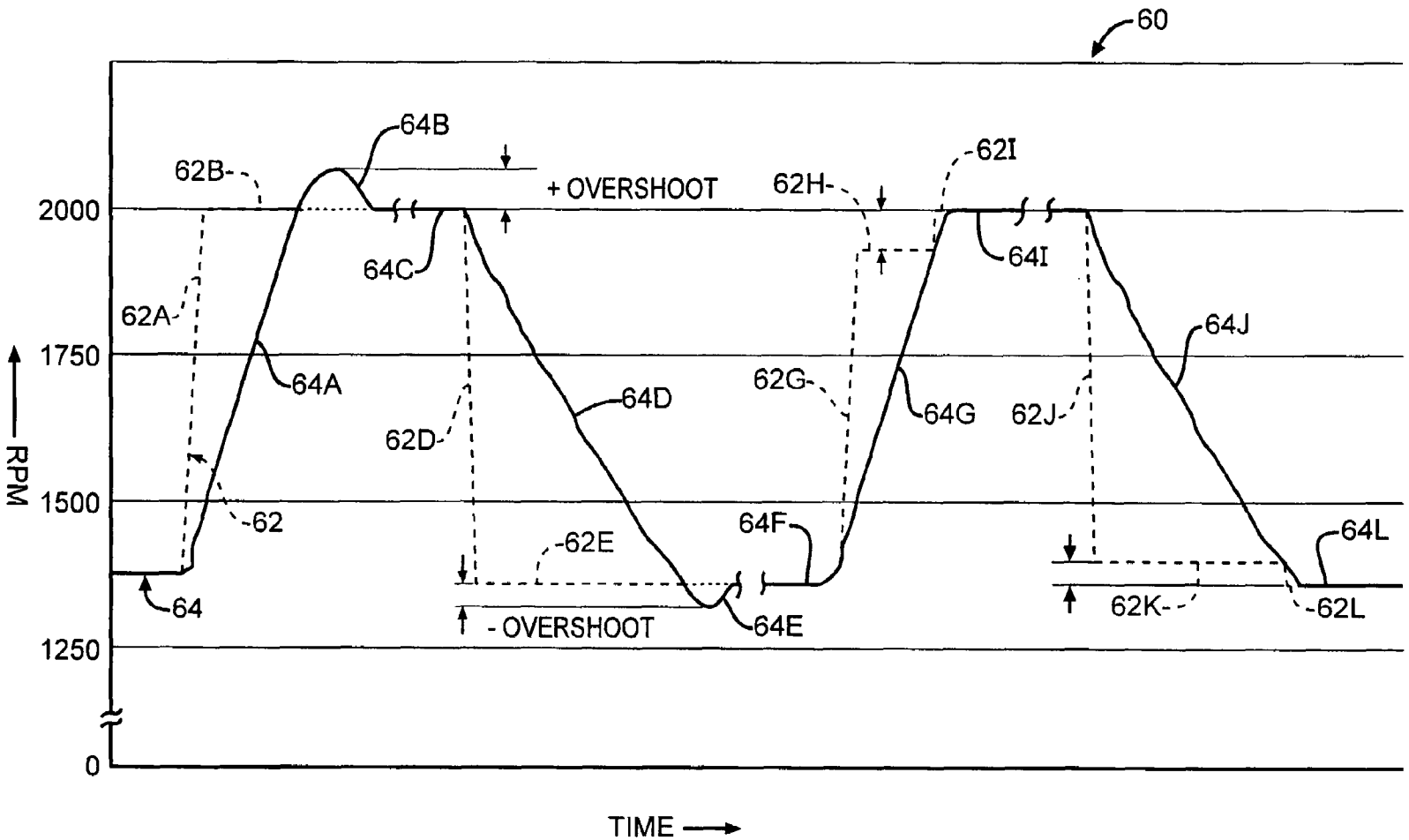
FIG. 2 is a graph illustrating both a learning cycle and an operating cycle of a method for reducing engine speed overshoot according to the present invention.

Turning now to FIG. 2, a graph 60 of rpm of the engine or prime mover 12 versus time presents two operating cycles of prime mover acceleration and deceleration: the first cycle being an overshoot detection and learning cycle and the second cycle representing subsequent cycles wherein the overshoot characteristics of the engine or prime mover 12 learned in the first cycle are utilized to compensate for and minimize overshoot. In the graph 60, a dashed line 62 at all times represents the commanded speed of the prime mover 12 as signaled by the master controller 20 and a solid line 64 represents the actual rpm or rotational speed of the engine or prime mover 12. By way of example, the prime mover 12 is initially rotating at approximately 1375 rpm. At a certain time, the master controller 20 provides and the prime mover 12 receives a command indicated by the dashed line 62A to increase its speed from the current value of 1375 rpm to approximately 2000 rpm. The master controller 20 then provides a steady state output signal represented by the horizontal dashed line 62B to maintain the speed of the engine or prime mover 12 at 2000 rpm. The speed of the prime mover 12, of course, lags the command as illustrated by the sloping line 64A. Furthermore, because of the inertia of the prime mover 12 and other factors, its speed overshoots to, for example, approximately 2075 rpm, as illustrated by the curve 64B, and then settles back or decays to the commanded 2000 rpm as illustrated by the horizontal solid line 64C. This (positive) overshoot value of approximately 75 rpm is stored in the master controller 20.

At some subsequent time, as illustrated by the dashed line 62D, the master controller 20 commands deceleration of the prime mover 12, again for purposes of example, to 1375 rpm, and the master controller 20 then provides a steady state output represented by the horizontal dashed line 62E. The speed of the prime mover 12 decays along the line 64D. However, once again because of the inertia of the prime mover 12 and other factors, its speed overshoots, that is, goes lower than the desired 1375 rpm, as illustrated by the curve 64E to approximately 1325 rpm, and then settles back to the commanded speed of 1375 rpm as illustrate by the horizontal line 64F. This overshoot value, in the negative direction, of approximately 50 rpm, in the example, is also stored in the master controller 20.

On all subsequent operating cycles, a command to change the speed of the engine or prime mover 12 is transmitted to the prime mover 12 but is corrected or adjusted by the previously detected quantitative overshoot values or functions thereof and stored in the master controller 20. Thus, if the target speed of the engine or prime mover 12 is 2000 rpm, and the overshoot sensed in the previous cycle is 75 rpm, an adjusted target of 1925 rpm or a target value which is a function of the 75 rpm overshoot value will be provided to the prime mover 12 as indicated by the dashed line 62G and the horizontal dashed line 62H. The speed of the engine or prime mover 12 increases along the line designated 64G. When the speed of the prime mover 12 approximately equals the adjusted or reduced target speed of 1925 rpm, the target speed is then readjusted to the full target speed as illustrated by the dashed line 62I and the speed of the engine or prime mover 12 settles quickly at the desired target speed of 2000 rpm, as indicated by the horizontal line 64I. Later, a reduction in the speed of the engine or prime mover 12 will be commanded as illustrated by the dashed line 62J and the speed of the prime mover 12 will thus decay along the line 64J. As the speed drops, the target speed will not be the actual final target speed, for example, 1375 rpm, but will be a slightly higher target speed, i.e. the target or commanded speed adjusted by the previously sensed deceleration overshoot, for example, 50 rpm or a value which is a function of this value. Thus the target speed at the end of the deceleration line 62J will be 1425 rpm as indicated by the horizontal dashed line 62K. When the prime mover 12 has decelerated to approximately this speed, the final target speed of 1375 rpm will be provided to the prime mover 12 as indicated by the line 62L and its speed will quickly settle at the target speed of 1375 as indicated by the horizontal line 64L.

Figure 3A:
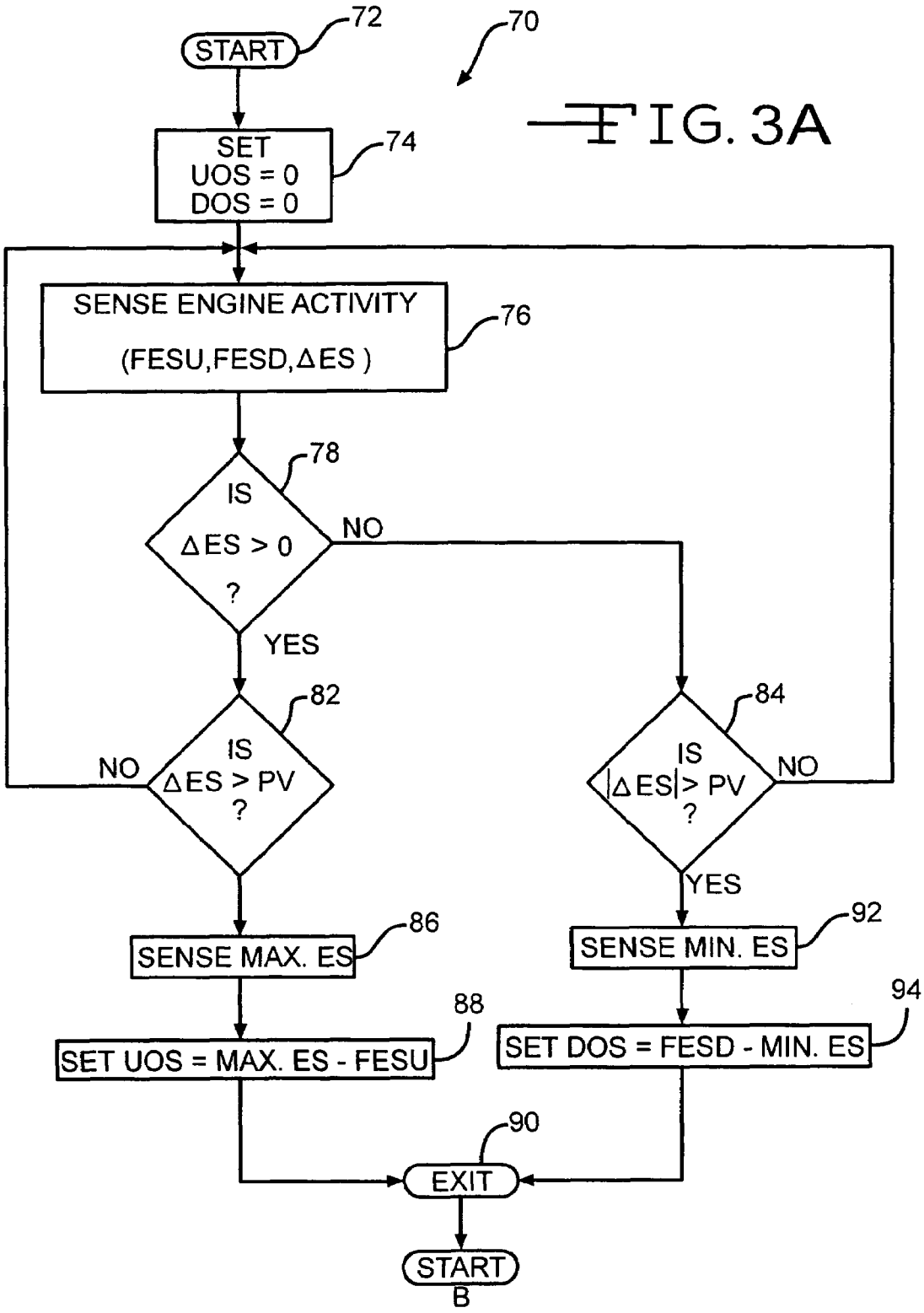
FIGS. 3A and 3B are flow charts of computer programs or software illustrating in diagrammatic form the steps of the method for reducing engine speed overshoot according to the present invention.

Referring now to FIG. 3A, a first computer program or software according to the present invention is illustrated and designated by the reference number 70. This first computer program or software 70 corresponds to the learning activity on the left half of the graph 60 illustrated in FIG. 2. The first computer program or software 70 commences with a start or initialization step 72 which clears registers and which may include a process step 74 which sets an up or positive overshoot value (UOS) to zero and a negative or down overshoot value (DOS) also to zero. Alternatively, a median or average overshoot value which may be experimentally or empirically determined such as 50 for the UOS value and 30 for the DOS value may be set or stored as initial or default values. Additionally, stored UOS and DOS values may be averaged with new determined values to adjust, over time, these values to acknowledge and accommodate, for example, different operators' habits or slowly shifting component performance. The program 70 then moves to a process step 76 which senses or determines activity and commands to the engine or prime mover 12. Such commands and activity may include a final engine speed increase or up command (FESU), a final engine speed reduction or down command (FESD) and the change in engine speed (ΔES), either positive or negative, represented by the command which is the difference between the current speed of the engine or prime mover 12 and the final commanded speed. Alternatively, the sensed change in engine speed per unit time (dES/dt) may be utilized to determine whether the speed of the engine or prime mover 12 is increasing or decreasing.

Next, the program 70 moves to a decision point 78 which inquires whether the commanded change of speed of the engine or prime mover 12 is positive or negative, i.e., an increase (acceleration) or a decrease (deceleration) according to whether ΔES is greater than zero or less than zero, respectively. If ΔES is greater than zero, the speed of the engine or prime mover 12 is or will be increasing and the decision point is exited at YES. If ΔES is less than zero, the speed of the engine or prime mover 12 is or will be decreasing and the decision point is exited at NO. Alternatively, the decision point 78 may inquire whether the derivative of engine speed, i.e., change of engine speed per unit time (dES/dt) is greater than zero, i.e., is positive. If it is, the speed of the engine or prime mover 12 is increasing. If the derivative value dES/dt is less than zero, i.e., is negative, the speed of the engine or prime mover 12 is decreasing.

If the decision point 78 is exited at YES, the program 70 moves to a decision point 82 which inquires whether a commanded change in engine speed is greater than a predetermined value (PV). This predetermined value (PV) is an experimentally or empirically determined value which ensures that the learning activity of the program 70 is associated with a sufficiently large change in speed of the engine or prime mover 12 that a substantial and sensible overshoot of the speed of the engine or prime mover 12 will be experienced. In other words, if only a small change (ΔES) of the speed of the prime mover 12 is commanded, overshoot will typically be negligible or small. Thus, a predetermined value (PV) of 200 or 300 rpm or more will typically be suitable. A smaller predetermined value will allow the program 70 to learn with a smaller change in speed of the engine or prime mover 12 but such smaller change in speed may not result in detection of an optimum or suitable overshoot value.

Correspondingly, if the decision point 78 is exited at NO, the program 70 moves to a decision point 84 which determines whether the absolute value of engine speed difference (ΔES) is greater than a predetermined value (PV). This predetermined value may be the same value as utilized in the process step 82 but will more typically be a smaller value since the negative overshoot of the decelerating engine or prime mover 12 will typically be smaller than the positive overshoot of the accelerating engine or prime mover 12. Thus, the predetermined value (PV) for the decision point 84 may be 100 rpm or more or less.

With regard to both decision points 82 and 84, if the commanded engine speed change (ΔES) is below the predetermined value, both the decision points 82 and 84 are exited at NO and the first program 70 returns to the beginning of the process step 76 which once again senses activity of the engine or prime mover 12 to detect a commanded increase or decrease of the speed of the engine or prime mover 12.

Returning then to the decision point 82, if the commanded speed change of the engine or prime mover 12 is greater than the predetermined value (PV), the decision point 82 is exited at YES and the first program 70 moves to a process step 86 which monitors and determines the resulting maximum speed of the engine or prime mover 12 in response to the command of the master controller 20 to increase the speed of the engine or prime mover 12. Next, the first program 70 moves to a process step 88 which sets or resets the value of up or positive overspeed, (UOS) to the difference between the maximum sensed speed of the engine or prime mover 12 and the commanded final engine speed. This difference is the positive overshoot which is evidenced by the curve 64B in FIG. 2. At this point, the first program 70 has learned the positive or accelerating overshoot value (UOS) of the prime mover 12 and the first program 70 is exited at the process step 90.

Returning to the decision point 84, if the absolute value of the change of speed of the engine or prime mover 12 is greater than the predetermined value (PV), the decision point 84 is exited at YES and the first program 70 moves to a process step 92 which senses the minimum speed of the engine or prime mover 12. Once the minimum speed has been sensed, the program 70 moves to a process step 94 which sets the negative or down overshoot value (DOS) to the difference between the commanded final decelerated speed of the engine or prime mover 12 and the actual sensed minimum speed. This represents the curve 64E in FIG. 2. The program 70 then exits at the process step 90.

Figure 3B:
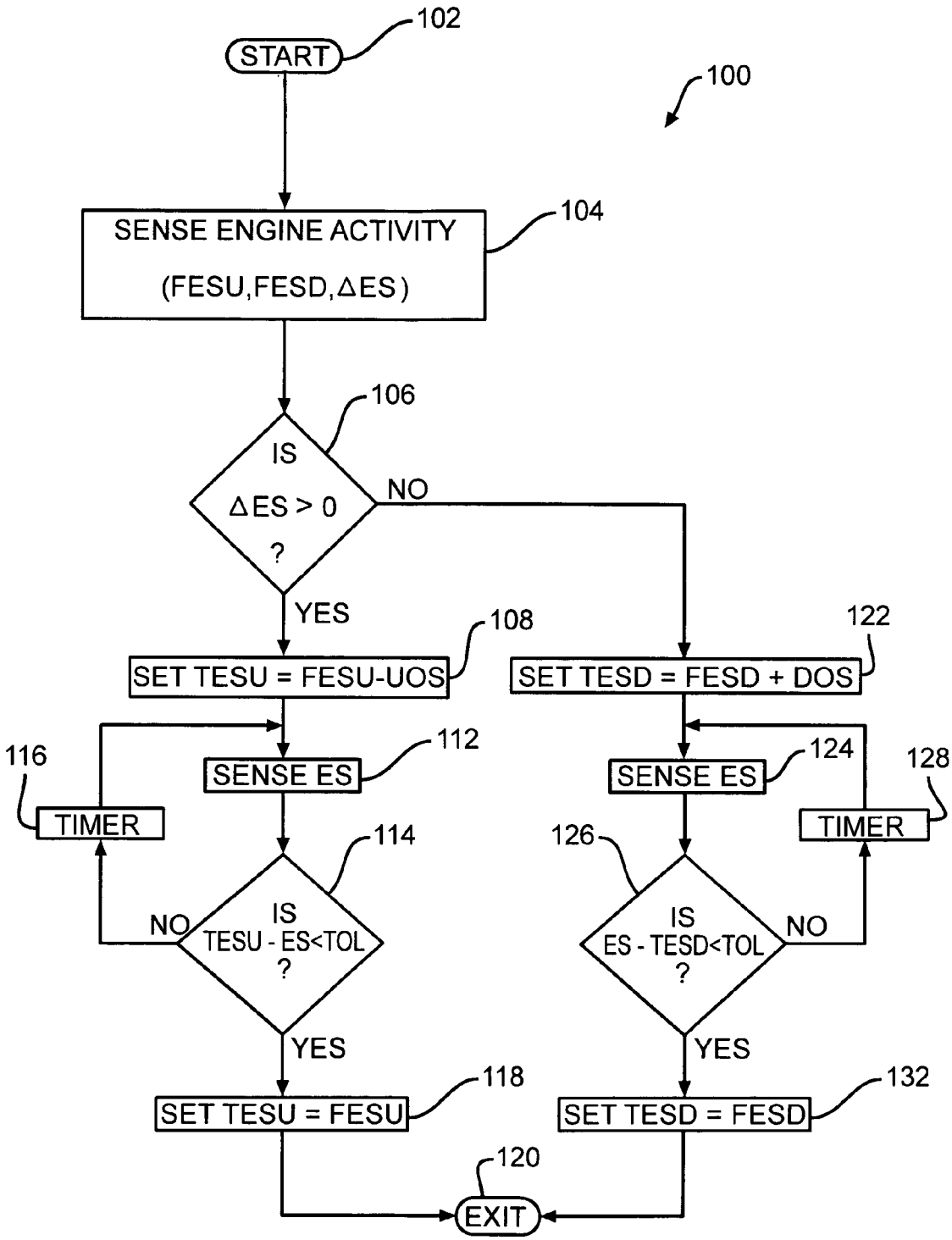

Turning now to FIG. 3B, the positive or up overshoot value (UOS) and the negative or down overshoot value (DOS) learned in the first program or software 70 is now utilized in a second and similar computer program or software 100. This second computer program or software 100 corresponds to the activity on the right half of the graph 60 illustrated in FIG. 2. The second program 100 which may follow directly from the first program 70 begins with an initialization step 102 and moves to a process step 104 which senses the activity of the engine or prime mover 12 much as the process step 76 functions in the first program 70. That is, data regarding a final increased engine speed command (FESU), a final decreased engine speed command (FESD), a change in the engine speed (ΔES) or alternatively, a change in engine speed per unit time, which both indicate whether the speed of the engine or prime mover 12 is increasing or decreasing are provided to the master controller 20.

The second program 100 then moves to a decision point 106 which determines whether the commanded change in engine speed (ΔES) is greater than zero or less than zero and thus whether the engine is accelerating or decelerating, respectively. If the commanded change in engine speed (ΔES) is greater than zero, i.e., positive, the engine or prime mover 12 is accelerating and the decision point 106 is exited at YES. If the commanded change in engine speed (ΔES) is less than zero, i.e., negative, the engine or prime mover 12 is decelerating and the decision point 106 is exited at NO. Alternatively, the decision point 106 can inquire whether the commanded or sensed change in the speed of the engine or prime mover 12 per unit of time (dES/dt) is greater than zero, i.e., positive, and thus that the engine or prime mover 12 is accelerating or is less than zero, i.e., negative, and thus that the engine or prime mover 12 is decelerating.

If the decision point 106 is exited at YES, the program 100 moves to a process step 108 which sets a temporary target speed (TESU) for the speed of the engine or prime mover 12 to a value which is the commanded final engine speed (FESU) minus the up overshoot value determined in the program 70 discussed directly above. Alternatively, the up overshoot value (UOS) may be a function of a sensed variable such as the speed of the engine or prime mover 12 before this speed increase event occurred or the change of position of the throttle pedal 28, a throttle kickdown increasing the UOS value by a predetermined factor or value and a partial throttle change reducing the UOS value by a predetermined factor or value. For purposes of example and simplicity, it will be assumed that the sensed overshoot is 75 rpm and that the final target speed of the engine or prime mover 12 (FESU) is 2000 rpm. Thus, the process step 108 sets the target speed (TESU) at 1925 rpm. Then the second program 100 moves to a process step 112 which senses the actual speed of the engine or prime mover 12.

Next, a decision point 114 is entered which inquires whether the previously set temporary target engine speed (TESU) minus the current speed (ES) of the engine or prime mover 12 is less than a small error or tolerance value (TOL). Typically, the error or tolerance value (TOL) is a small whole number less than 10 r.p.m. but which may be raised or lowered to suit particular component variables. If the adjusted or temporary target speed (TESU) set in the process step 108 minus the speed (ES) of the engine or prime mover 12 is not less than the error or tolerance value (TOL), the decision point 114 is exited at NO, a process timer 116 times out a short interval and the speed of the engine or prime mover 12 is again sensed in the process step 112. This cycle repeats until the temporary target speed (TESU) set in the process step 108 minus the speed (ES) of the engine or prime mover 12 is less than the error or tolerance value (TOL). When it is, the decision point 114 is exited at YES and the second program 100 enters a process step 116 which then resets the commanded engine speed to be the actual, initially commanded engine speed (FESU) which, in the example given, is 2000 rpm. As noted above, the engine or prime mover 12 then quickly and without significant overshoot moves to the final targeted speed (FESU) of 2000 rpm and the second program 100 exits at a step 120 to be repeated as frequently as activity of the engine or prime mover 12 necessitates.

Returning to the NO output of the decision point 106, the second program 100 enters a process step 122 which sets a temporary deceleration target speed (TESD) of the engine or prime mover 12 as the commanded or final target speed (FESD) plus the down (deceleration) overshoot (DOS) value. Alternatively, the down overshoot value (DOS) may be a function of a sensed variable such as the speed of the engine or prime mover 12 before this speed decrease event occurred so the change of position of the throttle pedal 28; a throttle lift off increasing the DOS value by a predetermined factor or value and a partial throttle reduction reducing the DOS value by a predetermined factor or value. The program 100 then moves to a process step 124 which senses the actual speed of the engine or prime mover 12. Next, a decision point 126 is entered which determines whether the actual measured speed (ES) of the engine or prime mover 12 minus the temporary target deceleration speed (TESD) is less than a small error or tolerance value (TOL). If it is not, the decision point 126 is exited at NO and an interval timer 128 is allowed to run and elapse whereupon the speed of the engine or prime mover 12 is once again sensed in the process step 124. The cycle is repeated until the speed (ES) of the engine or prime mover 12 minus the temporary target deceleration speed (TESD) is less than the error or tolerance value (TOL). When it is, the decision point 126 is exited at YES and a process step 132 is entered which sets the final engine speed as the initially commanded speed (FESD) which is then quickly arrived at without significant overshoot. The second program 100 then moves to the exit step 120 and, as noted above, is repeated as necessary.

It will be appreciated that although the foregoing invention has been described in relation to an internal compulsion engine, it is equally suitable for use with other controlled devices, especially mechanical devices, exhibiting overshoot as a control variable is adjusted.

The foregoing disclosure is the best mode devised by the inventors for practicing this invention. It is apparent, however, that methods incorporating modifications and variations will be obvious to one skilled in the art of control methods for internal combustion engines. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. A method of changing an engine speed of an internal combustion engine comprising:

receiving a command at a controller to change an engine speed of an internal combustion engine from a first speed value to a second speed value;

calculating a third speed value by adjusting the second speed value by an offset value;

transmitting a first instruction to change the speed of the internal combustion engine to the third speed value;

determining that the speed of the internal combustion engine is within a tolerance value of the third speed value;

transmitting a second instruction to change the speed of the internal combustion engine to the second speed value.

2. The method of claim 1 wherein the command is a command to increase engine speed.

3. The method of claim 1 wherein the command is a command to decreases engine speed.

4. The method of claim 1 further comprising determining whether a difference between said first speed and said second speed is greater than a predetermined value.

5. The method of claim 1 wherein the controller also controls a transmission and a master clutch.

6. The method of claim 1 wherein the command to change the speed is received from a throttle position sensor.

7. A system for compensating for engine speed overshoot in an internal combustion engine system comprising:

a controller, operative to:

receive a command to change an engine speed of an internal combustion engine from a first speed value to a second speed value;

calculate a third speed value by adjusting the second speed value by an offset value;

transmit a first instruction to change the speed of the internal combustion engine to the third speed value;

receive a signal indicative of the engine speed of the internal combustion engine;

determine that the speed of the internal combustion engine is within a tolerance value of the third speed value; and transmit a second instruction to change the speed of the internal combustion engine to the second speed value.

8. The method of system of claim 7 wherein the command to change an engine speed of an internal combustion engine is received from a throttle position sensor.

9. The system of claim 7 wherein the command is a command to increases engine speed.

10. The system of claim 7 wherein the command is a command to decreases engine speed.

11. The system of claim 7 wherein the controller is further operative to determine whether a difference between said first speed and said second speed is greater than a predetermined value.

12. The system of claim 7 wherein said controller is further operative to control a transmission and master clutch.

13. The method of claim 1, further comprising determining the offset, comprising:

receiving a previous command to change the speed of the internal combustion engine from a first speed value to a second speed value;

transmitting a third instruction to change the speed of the internal combustion engine to the second speed value;

determining an actual speed of the internal combustion engine using an engine speed sensor in communication with an output of the internal combustion engine;

detecting a engine speed difference between the second speed value and an actual speed of the internal combustion engine; and calculating the offset using the engine speed difference.

14. The method of claim 13, wherein the previous command is a command to increase engine speed, and the actual speed is a maximum engine speed in response to the third instruction.

15. The method of claim 13, wherein the previous the previous command is a command to decrease engine speed, and the actual speed is a minimum engine speed in response to the third instruction.

16. The system of claim 7, wherein the signal indicative of the engine speed is received from an engine speed sensor in communication with an output of the internal combustion engine.

17. The system of claim 7, wherein the controller is further operative to:

receive a previous command to change the speed of the internal combustion engine from a first speed value to a second speed value;

transmit a third instruction to change the speed of the internal combustion engine to the second speed value;

determine an actual speed of the internal combustion engine using an engine speed sensor in communication with an output of the internal combustion engine;

detect a engine speed difference between the second speed value and an actual speed of the internal combustion engine; and calculate the offset using the engine speed difference.

18. The system of claim 17, wherein the previous command is a command to increase engine speed, and the actual speed is a maximum engine speed in response to the third instruction.

19. The system of claim 17, wherein the previous the previous command is a command to decrease engine speed, and the actual speed is a minimum engine speed in response to the third instruction.

20. A vehicle comprising:

an internal combustion engine;

a transmission operative to couple power from the internal combustion engine to a transmission output at a plurality of different gear ratios;

a clutch, controllably coupling and decoupling the internal combustion engine to the transmission;

a throttle position sensor;

an engine speed sensor in communication with an output of the internal combustion engine; and a controller, in communication with the internal combustion engine, the engine speed sensor, the clutch, and the transmission, operative to:

select a gear ratio of the transmission;

control the coupling and decoupling of the clutch;

receive a command from the throttle position sensor to change an engine speed of an internal combustion engine from a first speed value to a second speed value;

calculate a third speed value by adjusting the second speed value by an offset value;

transmit a first instruction to the internal combustion engine to change the speed of the internal combustion engine to the third speed value;

receive a signal from the engine speed sensor indicative of the engine speed of the internal combustion engine;

determine that the speed of the internal combustion engine is within a tolerance value of the third speed value; and transmit a second instruction to the internal combustion engine to change the speed of the internal combustion engine to the second speed value.

* * * * *

UNITED STATES PATENT AND TRADEMARK OFFICE

CERTIFICATE OF CORRECTION

PATENT NO. : 7,478,621 B2
APPLICATION NO. : 11/401777
DATED : January 20, 2009
INVENTOR(S) : Ronald P. Muetzel et al.

It is certified that error appears in the above-identified patent and that said Letters Patent is hereby corrected as shown below:

Column 8, claim 1, line 16, immediately after "value;" insert --and--.

Column 8, claim 2, line 19, immediately after "claim 1" insert --,--.

Column 8, claim 3, line 21, immediately after "claim 1" insert --,--; and in line 22, before "engine speed" delete "decreases" and substitute --decrease-- in its place.

Column 8, claim 4, line 23, immediately after "claim 1" insert --,--.

Column 8, claim 5, line 26, immediately after "claim 1" insert --,--.

Column 8, claim 6, line 28, immediately after "claim 1" insert --,--.

Column 8, claim 8, line 47, after "The" delete "method of" and immediately after "claim 7" insert --,--.

Column 8, claim 9, line 50, immediately after "claim 7" insert --,-- and in line 51, before "engine speed" delete "increases" and substitute --increase-- in its place.

Column 8, claim 10, line 52, immediately after "claim 7" insert --,-- and in line 53, after "command to" delete "decreases" and substitute --decrease-- in its place.

Column 8, claim 11, line 54, immediately after "claim 7" insert --,--.

Column 8, claim 12, line 58, immediately after "claim 7" insert --,--.

Column 8, claim 12, line 58, immediately after "transmission and" insert --a--.

Column 9, claim 13, line 4, before "engine speed difference" delete "a" and substitute --an-- in its place.

UNITED STATES PATENT AND TRADEMARK OFFICE

CERTIFICATE OF CORRECTION

PATENT NO. : 7,478,621 B2
APPLICATION NO. : 11/401777
DATED : January 20, 2009
INVENTOR(S) : Ronald P. Muetzel et al.

It is certified that error appears in the above-identified patent and that said Letters Patent is hereby corrected as shown below:

Column 9, claim 15, line 12, after "claim 13, wherein" delete "the previous".

Column 9, claim 17, line 30, before "engine speed difference" delete "a" and substitute --an-- in its place.

Column 10, claim 19, line 1, after "claim 17, wherein" delete "the previous".

Signed and Sealed this

Eighteenth Day of August, 2009

David J. Kappos

David J. Kappos
*Director of the United States Patent and Trademark Office*